US010060132B2

(12) United States Patent
Beerer et al.

(10) Patent No.: US 10,060,132 B2
(45) Date of Patent: Aug. 28, 2018

(54) SHINGLE WITH FILM COVERED SURFACES

(71) Applicant: BUILDING MATERIALS INVESTMENT CORPORATION, Dallas, TX (US)

(72) Inventors: Margie A. Beerer, Ennis, TX (US); Matti Kiik, Richardson, TX (US); Sudhir Railkar, Wayne, NJ (US); Steven D. Kerr, Atlanta, GA (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 15/047,010

(22) Filed: Feb. 18, 2016

(65) Prior Publication Data

US 2016/0244969 A1 Aug. 25, 2016

Related U.S. Application Data

(60) Provisional application No. 62/118,880, filed on Feb. 20, 2015.

(51) Int. Cl.

| | |
|---|---|
| ***E04D 1/28*** | (2006.01) |
| ***E04D 1/20*** | (2006.01) |
| ***E04D 1/00*** | (2006.01) |

(52) U.S. Cl.

CPC ..... *E04D 1/28* (2013.01); *E04D 1/20* (2013.01); *E04D 2001/005* (2013.01)

(58) Field of Classification Search

CPC ..... E04D 1/28; E04D 1/20; E04D 2001/005
See application file for complete search history.

(56) References Cited

U.S. PATENT DOCUMENTS

| | | | |
|---|---|---|---|
| 5,902,683 | A | 5/1999 | Sieloff |
| 6,228,785 | B1 | 5/2001 | Miller et al. |
| 6,341,462 | B2 | 1/2002 | Kiik et al. |
| 6,546,688 | B1 | 4/2003 | Parsons |
| 6,564,682 | B1 | 5/2003 | Zurecki et al. |
| 6,709,994 | B2 | 3/2004 | Miller et al. |
| 6,808,785 | B1 | 10/2004 | Friedman et al. |
| 6,864,195 | B2 | 3/2005 | Peng |

(Continued)

*Primary Examiner* — Nathan L Van Sell
(74) *Attorney, Agent, or Firm* — Womble Bond Dickinson (US) LLP

(57) ABSTRACT

An asphalt-based shingle is formed with a substrate saturated with asphalt, an asphalt coating on the saturated substrate, and a top film bonded to the surface of the asphalt coating covering at least a portion of the shingle to be exposed when installed. The top film may be configured to mimic the appearance of traditional clay granules on the shingle or another shingle surface. More specifically, the top film is printed or coated with an image that mimics the appearance of a clay granule bed and is embossed, pressed, or molded to mimic the texture of a clay granule bed. The top film is UV resistant to protect the asphalt below from deterioration. An anti-stick film may be bonded to the back of the shingle to prevent shingles from sticking together when stacked into a bundle. A method of fabricating the shingle may include applying pre-fabricated film to the shingle substrate during shingle manufacturing or extruding a polymer film onto the substrate and subsequently printing and embossing the film during shingle manufacturing.

14 Claims, 4 Drawing Sheets

(56) References Cited

U.S. PATENT DOCUMENTS

| | | | | |
|---|---|---|---|---|
| 7,048,990 | B2 | 5/2006 | Koschitzky | |
| 7,070,843 | B2 | 7/2006 | Bartek et al. | |
| 7,070,844 | B2 | 7/2006 | Bartek | |
| 7,140,153 | B1 | 11/2006 | Humphreys et al. | |
| 7,442,270 | B2 | 10/2008 | Bartek | |
| 7,442,658 | B2 | 10/2008 | Rodrigues et al. | |
| 7,670,668 | B2 * | 3/2010 | Greaves | B32B 27/08 428/142 |
| 7,851,051 | B2 | 12/2010 | DeJarnette et al. | |
| 8,226,790 | B2 | 7/2012 | Rodriques et al. | |
| 8,266,861 | B2 | 9/2012 | Koch et al. | |
| 8,277,881 | B2 | 10/2012 | Khan et al. | |
| 8,309,169 | B2 | 11/2012 | Teng et al. | |
| 8,333,040 | B2 | 12/2012 | Shiao et al. | |
| 8,389,103 | B2 | 3/2013 | Kiik et al. | |
| 8,557,366 | B2 | 10/2013 | Harrington, Jr. et al. | |
| 8,826,607 | B2 | 9/2014 | Shiao et al. | |
| 2003/0188503 | A1 | 10/2003 | Parsons | |
| 2004/0014385 | A1 | 1/2004 | Greaves, Jr. et al. | |
| 2004/0081789 | A1 | 4/2004 | Kim | |
| 2005/0210808 | A1 | 9/2005 | Larson et al. | |
| 2005/0260309 | A1 | 11/2005 | Hagemeyer et al. | |
| 2006/0172643 | A1 * | 8/2006 | Greaves | B32B 27/08 442/136 |
| 2009/0260309 | A1 | 10/2009 | Humphreys et al. | |
| 2010/0005745 | A1 | 1/2010 | Harrington, Jr. | |
| 2010/0212235 | A1 | 8/2010 | Barrego | |
| 2011/0017278 | A1 | 1/2011 | Kalkanoglu et al. | |
| 2011/0104461 | A1 | 5/2011 | Grubka | |
| 2011/0232220 | A1 | 9/2011 | Belt et al. | |
| 2014/0259820 | A1 | 9/2014 | Humphreys et al. | |

* cited by examiner

SHINGLE WITH FILM COVERED SURFACES

REFERENCE TO RELATED APPLICATION

Priority is hereby claimed to the filing date of U.S. provisional patent application 62/118,880 entitled Shingle with Film Covered Surfaces, which was filed on 20 Feb. 2015. The entire content of this provisional patent application is hereby incorporated by reference.

TECHNICAL FIELD

This disclosure relates generally to roofing shingles and more specifically to roofing shingles having printed and/or embossed films applied to one or more surfaces in lieu of fines and/or granules.

BACKGROUND

Ceramic granules have been applied to asphaltic shingles for decades to protect the asphalt below from deterioration by ultraviolet (UV) radiation and direct exposure to the elements. While ceramic granules have been successful, and are considered architecturally attractive, they nevertheless suffer from various shortcomings. For example, ceramic granules have become increasingly more expensive over the years and the distribution, handling, and application of ceramic granules can be a significant portion of the cost of manufacturing an asphaltic shingle. Further, ceramic granules tend to become loose and fall off of their shingles over time, which gradually exposes more of the asphalt to the environment thus hastening deterioration of the shingle. Also, applying granules to an asphalt coated substrate during manufacture requires large sophisticated machinery to drop the granules onto the asphalt as it moves along a processing path. This requirement can limit the speed of production and it can be difficult to obtain granule patterns on the substrate with sharp well defined edges.

In addition to the exposed portion of a shingle, various fines such as fine sand commonly is applied to the backs of asphalt shingles to prevent the shingles from sticking together when packaged together in a shingle bundle. This too can be a tedious process during manufacture and fines are not always completely successful for their intended purpose.

There is a need for a asphalt-based shingle having a protective layer that protects the asphalt below from deterioration by the elements for extended periods of time, that does not gradually fall off of the shingles, that is simpler and more precise to apply during fabrication, that is more efficient to manufacture and distribute, and that mimics the architectural appearance of traditional granule coated shingles on a roof, or projects completely new aesthetics. There also is a need for a coating other than sand or other fines on the backs of shingles to prevent them from sticking together. It is to the provision of a shingle and method that meets these and other needs and that exhibits advantages not possible with granules and fines that the present invention is primarily directed.

SUMMARY

Briefly described, an asphalt shingle comprises a substrate that is saturated and coated with a layer of asphalt. The shingle has a headlap portion to be covered by a next higher course of shingles when installed on a roof and an exposed portion to be exposed when installed. A sheet of protective polymeric film is applied at least to the exposed portion of the shingle and is adhered to the asphalt coating. In one embodiment, the film is coated or printed with images that mimic the appearance of traditional ceramic granules. In other embodiments, the film is printed or coated to display new and unique shingle aesthetics. Further, the film may be embossed or otherwise textured to mimic the roughness of traditional ceramic granules or other textures on a shingle.

The resulting shingle, when installed on a roof, may closely mimic the appearance of a traditional granule covered asphalt shingle or may exhibit new and non-traditional aesthetics. However, the polymeric film can provide UV protection and protection from the elements that is superior to that provided by traditional ceramic granules. Manufacturing printed and embossed polymeric films can be significantly less complex than mining and manufacturing ceramic granules and distribution and application of films can be less cumbersome and complicated than for ceramic granules. In fact, films may even be applied through an in-line extrusion process wherein molten polymer is extruded directly onto the asphalt coated substrate during the manufacturing process. Finally, modern coating, printing, and texturing process for polymeric films make possible color, texture, and shading that simply is not possible by dropping ceramic granules onto a moving asphalt coated sheet.

The disclosure also includes eliminating fine sand or other fines from the backs of asphalt shingles and replacing the fines with a non-stick sheet of polymeric material to prevent shingles from sticking together in a stacked bundle.

It will thus be seen that the shingle disclosed herein addresses the problems and shortcomings of granule covered asphaltic shingles and provides additional benefits not available with granule covered shingles. These and other features, aspects, and advantages of the disclosed shingle will become more apparent to the skilled artisan upon review of the detailed description set forth below when taken in conjunction with the accompanying drawing figures, which are briefly described as follows.

DETAILED DESCRIPTION

Figure 1:
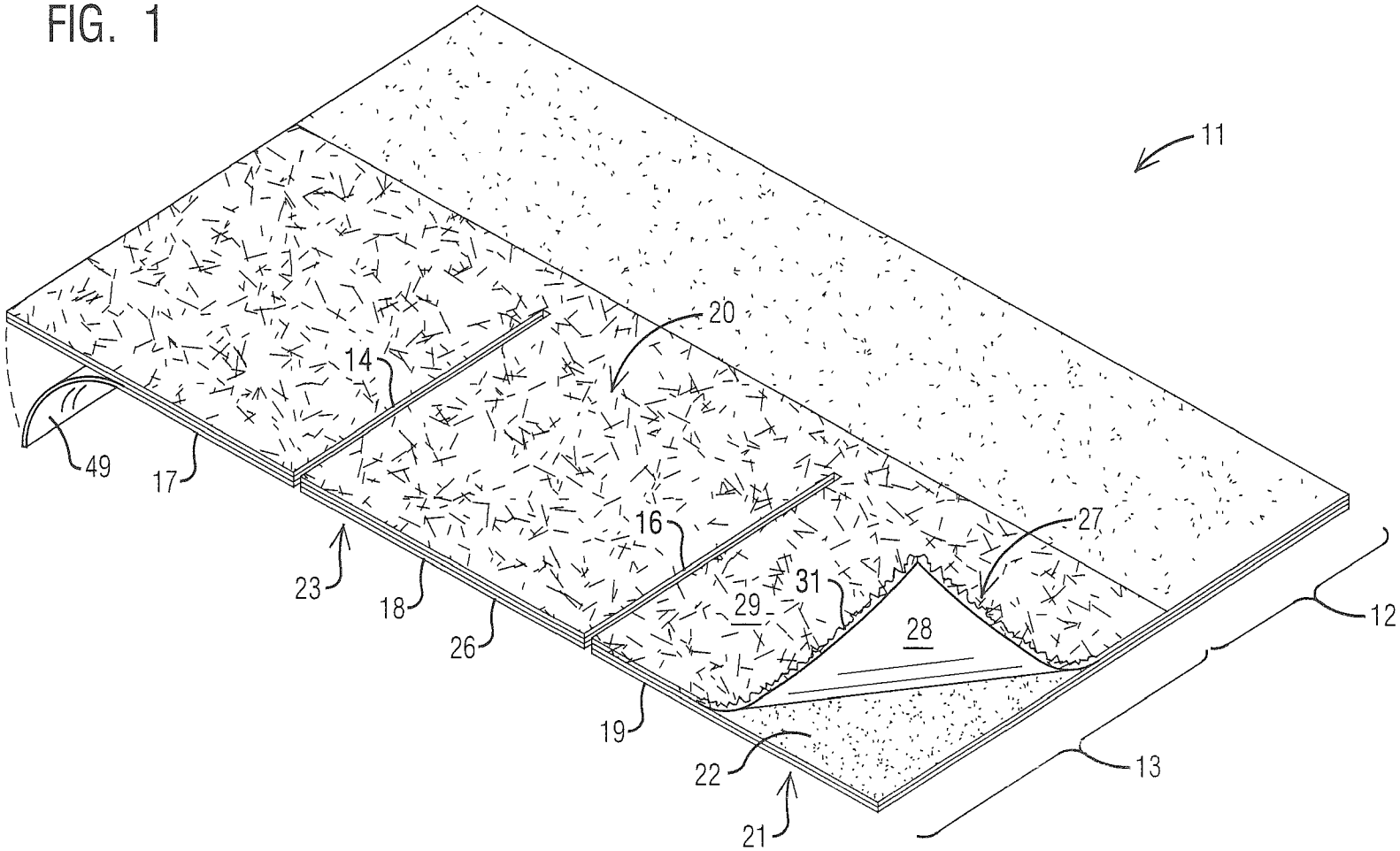
FIG. 1 is a perspective view of an asphalt shingle that embodies principles of the present invention in one preferred form.

Reference will now be made in detail to the drawing figures, wherein like reference numerals indicate like parts throughout the several views. FIG. 1 shows a standard asphalt shingle 11 having a headlap portion 12 and an exposed portion 13. The headlap portion 12 is configured to be covered by the exposed portions of shingles in a next higher course of shingles on a roof. The exposed portion 13 in the illustrated embodiment is divided by slots 14 and 16 into three tabs 17, 18, and 19 to form a traditional three tab shingle. The shingle has an upper surface 20 and a lower surface 23. While a simple single layer three tab shingle is illustrated for clarity in FIG. 1, it should be understood that the present invention is not limited to such shingles, but can be applicable to virtually any asphalt-based shingle such as, for instance, multi-layer architectural shingles, roll shingles, and ridge cap shingles.

The upper surface 20 of the shingle 11 comprises a polymeric film 27 that is adhered to the asphalt 22 of the shingle and covers at least the exposed portion 13 of the shingle. The film 27 has a bottom surface 28 that is adhered to the asphalt 22 and a top surface 31. At least the top surface 31 of the polymeric film is configured in this embodiment to mimic the appearance of traditional clay granules on a granule covered shingle. To accomplish this, the polymeric film 27 preferably bears an image reminiscent of a bed of clay granules. This image can be printed or coated on or infused in the film in virtually any color or combination of colors and can include faux shadows, striations, mixtures of colors, and other patterns. Further, since the image of the granule bed is printed or coated on the film, it can be applied with more precision than can clay granules dropped onto a moving asphalt coated substrate. In fact, granule patterns that are practically impossible using traditional granule drop technology can easily be printed or coated onto or infused into the polymeric film 27.

In addition to being printed or coated with an image of a granule bed, at least the top surface 31 of the polymeric film also preferably is embossed, pressed, or otherwise formed to mimic the texture of an actual clay granule bed on the shingle. Printed and embossed films of this type are available from a variety of manufacturers including, for example, 3M Corporation of Minneapolis, Minn.; Bloomer Plastics of Bloomer, Wis.; and Hutamaki North America of De Soto, Kans.

The polymeric film itself contains or is infused or impregnated with a material or materials that prevent UV radiation from penetrating the film. This protects the asphalt 22 below from deterioration by UV rays and the film itself shields the asphalt below from the elements. Accordingly both UV protection and virtually permanent protection from the elements is provided to the underlying asphalt 22 by the polymeric film 27. Further, the film will not gradually fall off of the shingle as clay granules do, and thus does not lose its effectiveness over time. While the film 27 is shown in FIG. 1 covering only the exposed portion 13 of the shingle 11, it will be understood that the film may be sized to cover the entire upper surface of the shingle including the headlap portion. However, even though within the scope of the invention, this may not be economically feasible due to the cost of the film.

As an alternative to applying a pre-manufactured film, the films of the present invention can be created and applied during the shingle manufacturing through an extrusion process. In such a process, molten polymer is extruded through a slot die directly onto the hot asphalt coating. This can be followed by printing and embossing of the applied filer, before it is completely cured at downstream stations to provide a desired aesthetic. One advantage of this extrusion process is that films that are substantially thinner than pre-manufactured films can be applied, thereby reducing manufacturing costs without compromising the protective and aesthetic qualities of the film. In addition, the need to source, ship, store, and handle rolls of pre-manufactured film can be eliminated.

The lower surface 23 of the shingle preferably comprises a polymeric film 49 that is adhered to and covers the lower surface. The purpose of the film 49 is to prevent shingles from sticking together when they are stacked into bundles. The film 49 therefore replaces the backdust of fine sand or other fines traditionally applied to the backs of shingles to prevent them from sticking together when bundled. Since the lower surface film 49 is not exposed on a shingled roof, the material of this film need not be as thick and robust as the film 27 on the exposed surface of the shingle. Further, it need not contain UV protective materials and certainly need not be printed and/or embossed as is the film 27 on the exposed layer. As a result, the lower surface film 49 can be significantly less expensive than the upper surface film 27 and more readily can cover the entire area of the lower surface 23 if desired. As with the film on the exposed surface, the back surface film can be applied from pre-manufactured rolls or extruded directly onto the back surface of shingle stock during shingle manufacturing.

Figure 2:
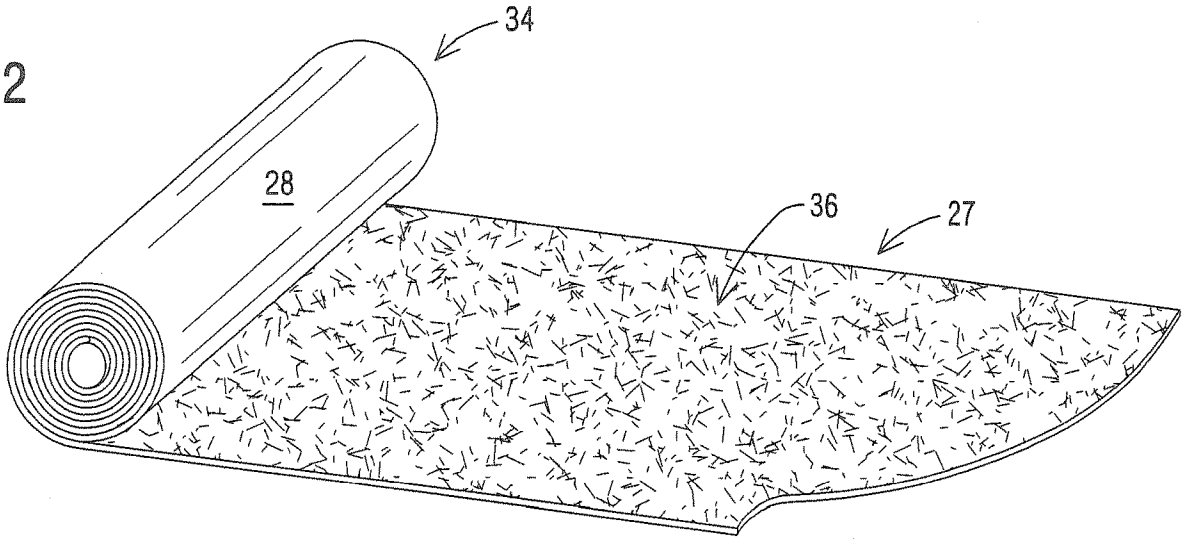
FIG. 2 is a perspective view of a roll of UV proactive film printed and embossed or otherwise textured according to the invention.

FIG. 2 illustrates a roll 34 of polymeric film material of the type that may be used on the upper or exposed side of asphalt shingles according to the invention. The roll contains a web of polymeric film material 27 that has previously been printed or coated with images of, for example, a granule bed. The web also previously has been embossed or otherwise formed to exhibit a surface texture that, in this example, mimics the texture of a traditional granule bed on an asphalt shingle. The web of film 27 can have any width desired to apply the film to an entire width of asphalt coated stock or along only selected strips of the stock so that when the stock is cut into shingles, the film covers only the desired portions of the resulting shingles, such as the exposed portions.

Figure 3:
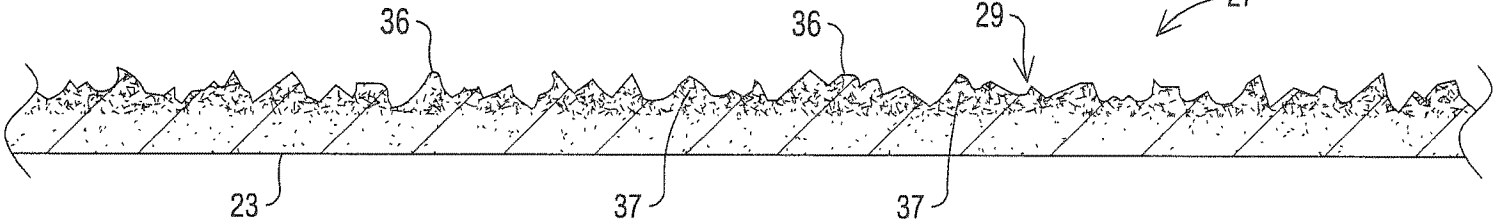
FIG. 3 is an edge view of a piece of the film of FIG. 2 showing the textured upper surface and pigment from the printing or coating on the film.

FIG. 3 is an edge view of a portion of a polymeric film 27 of the type that may be used to cover the upper surface of an asphalt shingle according to the invention. The film 27 is made of an extruded or otherwise formed sheet of polymeric material that is capable of resisting the elements for many years. Examples of such materials include, without limitation, a thermoplastic olefin (TPO) of the type used in low slope commercial roofing, Polyethylene, Polypropylene, and Polyvinyl Chloride (PVC). The film 27 has a bottom side 23 and a top side 29 and at least the top side 29 is printed, coated, infused, or otherwise provided with graphics 37 that mimic the look of a bed of traditional roofing granules. At least the top side 29 of the film is pressed, embossed, or otherwise formed to exhibit a texture that mimics the texture of a bed of traditional roofing granules. Printed and textured polymeric films are commercially available and can be custom specified from a number of sources as mentioned above.

Figure 4:
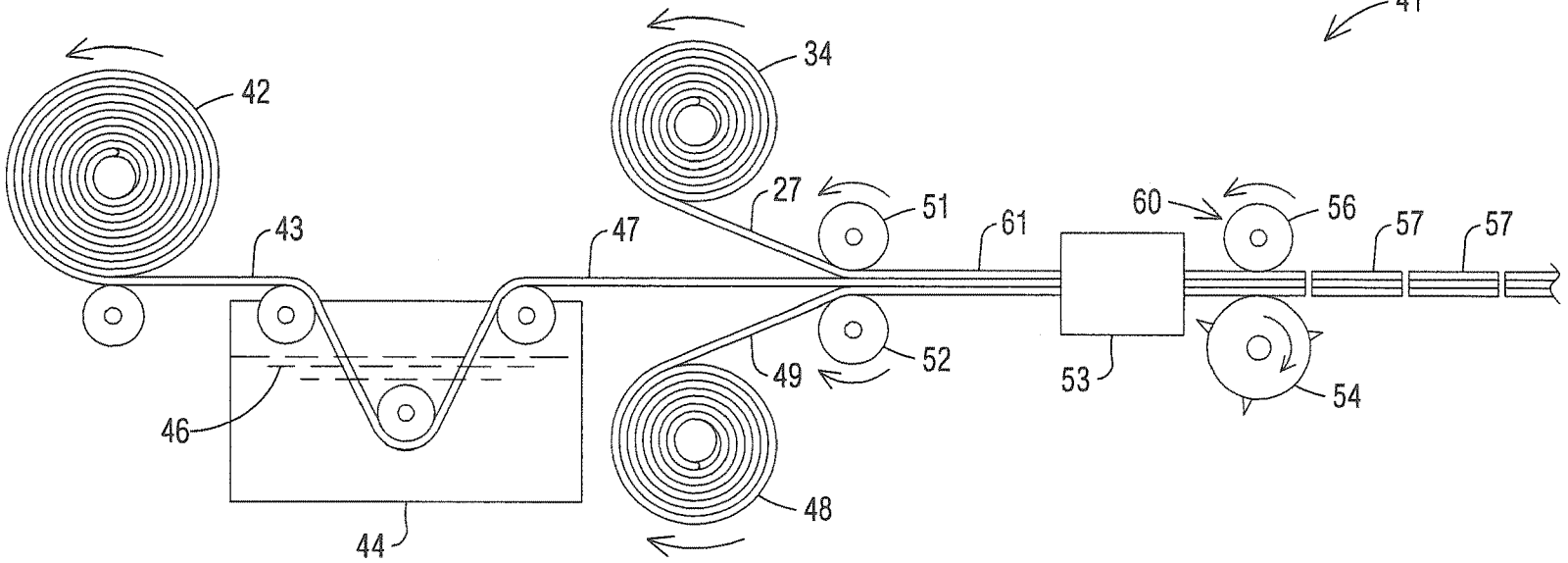
FIG. 4 is a simplified schematic drawing illustrating one method of fabricating shingles according to the invention.

FIG. 4 illustrates in very simplified schematic fore one possible method of fabricating a shingle 11 such as that shown in FIG. 1. A web of shingle substrate 43 such as a fiberglass mat is paid out from a roll 42 at the upstream end of a manufacturing line. The web of shingle substrate 43 is directed through a vat 44 of molten asphalt 46 such that it becomes impregnated and saturated with the molten asphalt to provide a waterproof substrate. Although not shown in FIG. 4, an asphalt coating typically is applied to the saturated substrate through a coating process well understood by those of skill in the art.

The saturated and asphalt coated substrate 47 is directed between a set of pinch rollers 51 and 52 at a downstream processing station. A web 27 of printed and embossed film is paid out from a roll 34 and directed between the pinch roller 51 and the upper surface of the asphalt coated web 47. Similarly, a web 49 of anti-stick film is paid out from a roll 48 and directed between pinch roller 52 and the lower surface of the asphalt coated web 47. Since the asphalt of the web is still at least partially molten and sticky, the printed and embossed film 27 bonds to the asphalt on the upper surface of the web 47. Similarly, the anti-stick film 49 bonds to the asphalt on the lower surface of the web 47. Shingle stock 61 emerges from the pinch rollers with printed embossed film adhered to and forming at least the portion of the upper surface of the stock that will become exposed tabs, and with anti-stick film adhered to and forming at least portion of the lower surface of the stock.

After the films have been adhered to the asphalt coated web 47 to form the shingle stock 61, the shingle stock 61 may pass through a curing station 53 where the asphalt can cool and cure making the bonds between the asphalt and the films substantially permanent. The stock may then pass through a cutting station 60 where it is cut into individual shingles 57 by a rotary cutter 54 and platen 56. Of course, the schematic of FIG. 4 is highly simplified and does not show a variety of components of a shingle manufacturing line such as, for instance, accumulators, slitters, self-seal strip applicators, catchers, and other components not immediately relevant to an understanding of the present invention. It will be appreciated, however, that the schematic of FIG. 4 does not include granule drop stations and back-dust application stations, nor does it include a clay drum used to recapture loose clay granules in a traditional shingle making process. One aspect of the present invention is the elimination of such components in favor of the much simpler film application illustrated in FIG. 4.

Figure 5:
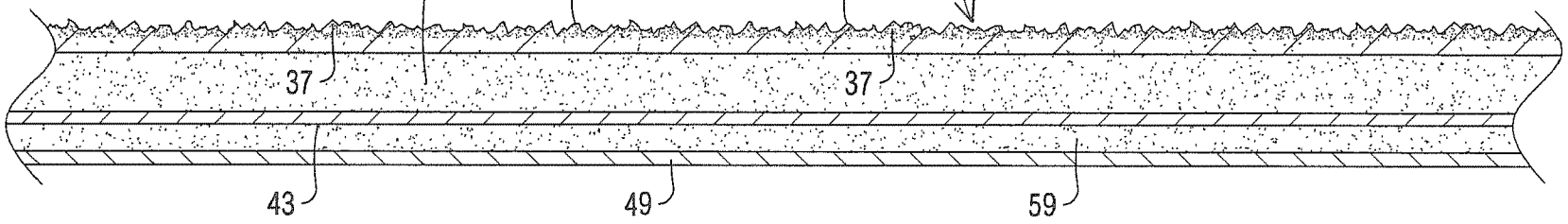
FIG. 5 is a cross sectional view of a section of a shingle made according to the invention showing the various materials of the shingle.

FIG. 5 is an enlarged cross section of a shingle 11 embodying principles of the present invention. The shingle 11 comprises a web of shingle substrate 43 saturated and coated with asphalt that forms a layer 58 above the substrate and a layer 59 below the substrate. A layer of film 27 is bonded at least to the exposed portions of the surface of the upper layer 58 and, as discussed above, is printed, coated, or otherwise provided with an image, indicated at 36, that may mimic the appearance of a traditional granule bed on the shingle. At least the surface of the film 27 that will be exposed is embossed, pressed, or otherwise formed to mimic the texture of a traditional granule bed. An anti-stick film 49 is bonded to the lower layer 59 of asphalt and is made to prevent shingles from sticking together when they are stacked into bundles after having been cut, this eliminating backdusting.

Figure 6:
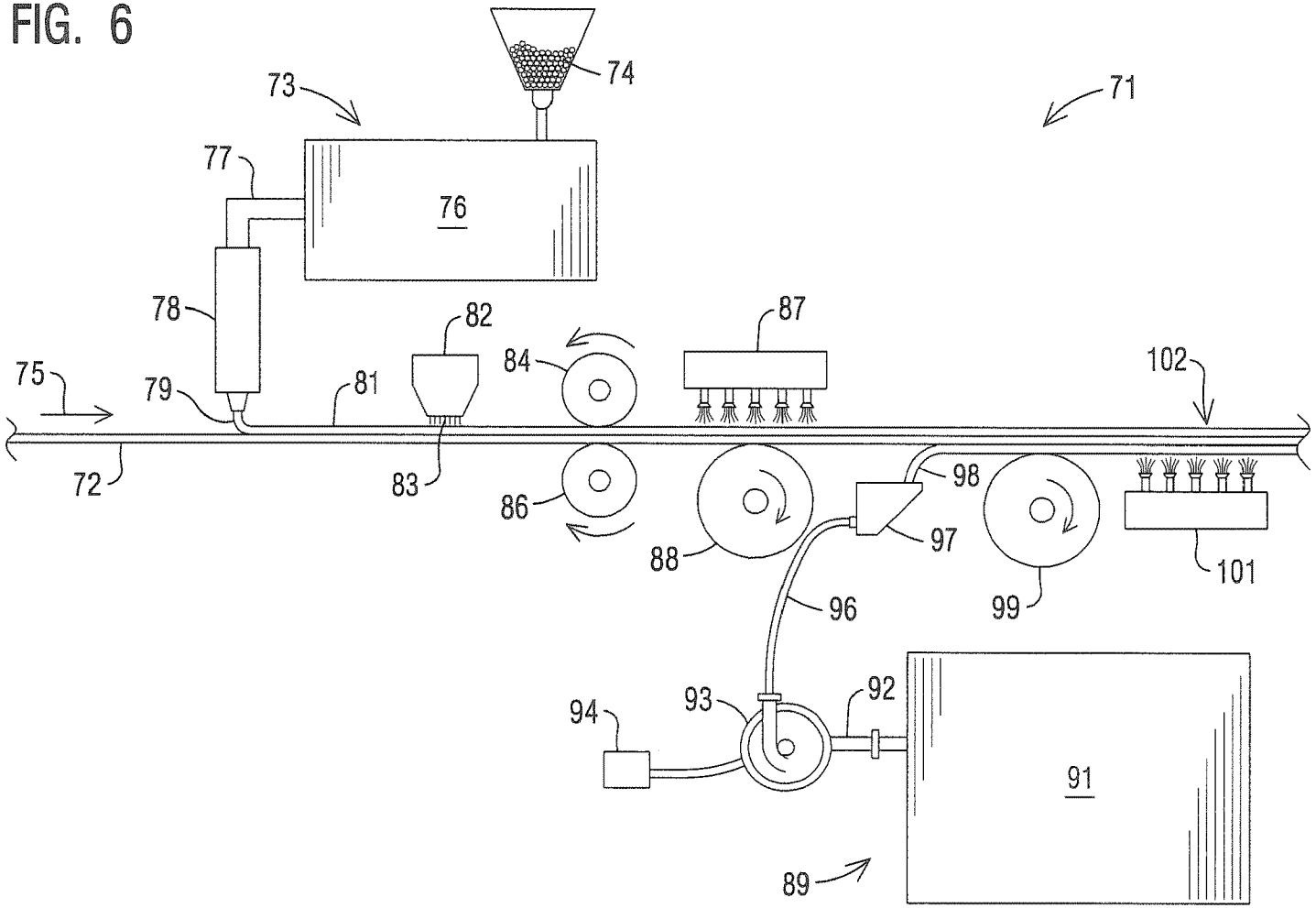
FIG. 6 is a simplified schematic drawing illustrating an alternate method of fabricating shingles according to the invention.

FIG. 6 illustrates an alternate methodology for applying films to asphalt shingles during the shingle manufacturing process according to the invention. The method is illustrated for clarity in a highly simplified shingle manufacturing line 71. A substrate 72, which has previously been saturated and coated with hot asphalt, is conveyed in the downstream processing direction 75. A film extruder system 73 is positioned along the processing path and may comprise a polymer bead hopper 74, an extruder 76 and a die 78 fed with hot molten polymer through conduit 77. Polymer pellets fed from the hopper are conveyed through the extruder 76 by internal screws and this process causes the pellets to melt before the polymer, now molten, is delivered to the die. The die may be one or more slot dies, through which curtains of molten polymer 79 are ejected onto the hot asphalt coating on the substrate 72. This forms one or more ribbons of polymer film on the asphalt, and the molten polymer and hot asphalt form a permanent interfacial bond.

The substrate with polymer ribbon(s) may then pass a printer or coater head 82, which is controlled to eject pigment onto the polymer ribbons to form an image thereon. The image may be designed to mimic the look of a traditional shingle surface such as clay granules, or it may be a new and novel design not found on traditional shingle surfaces. In any event, the printed or coated film next is passed between a rotating embossing roller 84 and a rotating platen 86. The embossing roller 84 has a peripheral surface that is textured and this texture is impressed in the still malleable polymer film on the asphalt coated substrate. The texture may be designed to mimic the texture of a traditional shingle surface such as, for example, clay granules or it may be some other desired texture. Further, the texture on the surface of the embossing roller 84 may be coordinated with the image printed or coated onto the polymer film so that the embossed texture applied to the film aligns with the image previously printed or coated onto the film for additional realism.

After having been printed and embossed, the still hot and malleable substrate may pass one or more cooling stations represented here by chilled air blower 87. The temperature of the substrate is cooled as it passes the cooling station(s) so that the asphalt and the extruded polymer film is at least partially cured and hardened. A second film extruder system 89 may include a reservoir of molten polymer 91 and an extrusion die 97 positioned and configured to eject molten polymer onto the back side of the shingle substrate. In FIG. 6, molten polymer is drawn through a conduit 92 by a pump 93, which delivers the molten polymer to an extrusion die 97 under pressure through conduit 96. A controller 94 may be operatively coupled to the pump to control the volume and pressure of molten polymer delivered to the extrusion die 97. The extrusion die, which may be a slot die, ejects a curtain of molten polymer 98 onto the back surface of the shingle substrate to form a thin polymer film on this back surface. The polymer film may then pass a cooling station 101 where it is cooled and cured to form a permanent bond with the asphalt coated substrate.

The result of the process illustrated schematically in FIG. 6 is a web of shingle stock with a printed and embossed film of polymer at least on the portions of the top surface that will be exposed and a non-stick film on the back surface. Shingles may then be cut from the web of shingle stock in the traditional way to form individual shingles, which are then stacked in bundles for shipment. This alternative method of forming shingles according to the invention may have significant advantages over the prior embodiment wherein polymer film is paid out from rolls of pre-manufactured polymer film and applied to the surfaces of shingle substrate. For instance, extruded films can be substantially thinner than applied film, the need to store and handle large rolls of film is eliminated, and the process is much more controllable and changeable.

Shingles of the present invention are at least equal in quality and durability to traditional granule coated shingles for a variety of reasons. First, modern UV resistant films protect the asphalt below from deteriorating UV radiation as well as do traditional ceramic granules. Second, appropriate polymeric films are more resistant to the elements than traditional granules. Third, the film of this invention is not subject to gradual loss of its effectiveness due to the slow loss of granules over time as is a traditional granule bed. Finally, distribution and application of films and extrusion of polymer films can be less complex than application of clay granules and thus can be cost competitive with granules.

The invention has been described herein in terms of preferred embodiments and methodologies considered by the inventors to represent the best modes of carrying out the invention. It will be understood by the skilled artisan, however, that a wide gamut of additions, deletions, and modifications, both subtle and gross, may be made to the exemplary embodiments illustrated and discussed herein without departing from the spirit and scope of the invention. For example, while the illustrative embodiment is designed to mimic the appearance of a traditional clay granule bed asphalt shingle, virtually any graphic can be printed or coated on the film. For instance, the film may be printed and/or coated to evoke the appearance of a slate shingle, a shake shingle, a barrel shingle, or any other type of traditional shingle material. Further, the film covered shingle of this invention raises the possibility of shingle designs and architecture that are new and unique and that don't merely mimic the appearance of traditional shingle materials. All of these possibilities and more are intended to be within the scope of the present invention.

What is claimed is:

1. An asphalt-based shingle comprising a fiberglass mat substrate having a top surface and a bottom surface, an asphalt coating on the top surface of the substrate and on the bottom surface of the substrate, a single top film layer having a first thickness bonded directly to the asphalt coating on the top surface of the substrate covering at least a portion of the shingle to be exposed when installed, the top film layer comprising TPO, polyethylene, polypropylene, or PVC and being infused or impregnated with a material or materials that prevent UV radiation from penetrating the film thereby protecting the asphalt coating below from UV degradation, a bottom film layer having a second thickness bonded directly to the asphalt coating on the bottom surface of the substrate, the second thickness being less than the first thickness and the bottom film layer not preventing UV radiation from penetrating the bottom film layer, the top film layer being configured to mimic the appearance of traditional clay granules on the shingle.

2. An asphalt-based shingle as claimed in claim 1 wherein the film has an image thereon that mimics the image of traditional clay granules.

3. An asphalt-based shingle as claimed in claim 2 wherein the image is printed onto the film.

4. An asphalt-based shingle as claimed in claim 2 wherein the image is coated onto the film.

5. An asphalt-based shingle as claimed in claim 1 wherein the film is textured to mimic the texture of traditional clay granules.

6. An asphalt-based shingle as claimed in claim 5 wherein the texture is embossed into the film.

7. An asphalt-based shingle as claimed in claim 5 wherein the texture is pressed into the film.

8. An asphalt-based shingle as claimed in claim 5 wherein the texture is molded into the film.

9. An asphalt-based shingle as claimed in claim 1 wherein the film is provided with an image that mimics the appearance of traditional clay granules and is textured to mimic the texture of traditional clay granules.

10. A shingle for use with like shingles for roofing a structure, the shingle comprising:

an asphalt saturated fiberglass mat substrate;

an asphalt coating on an upper surface of the substrate and an asphalt coating on a lower surface of the substrate;

a single layer film bonded directly to the asphalt coating on the upper surface of the substrate at least in areas of the shingle that are exposed to the elements when the shingle is installed on a roof, the single layer film having a first thickness and comprising TPO, polyethylene, polypropylene, or PVC and being infused or impregnated with a material or materials that prevents UV radiation from penetrating the single layer film thereby protecting the asphalt coating below from UV degradation;

a bottom film layer having a second thickness bonded directly to the asphalt coating on the bottom surface of the substrate, the second thickness being less than the first thickness, the bottom film layer not preventing UV radiation from penetrating the bottom film layer;

the single layer film bonded to the top surface being configured to exhibit the appearance of a predetermined surface material on the exposed areas of the shingle.

11. A shingle as claimed in claim 10 wherein the film is configured to exhibit the appearance of traditional clay granules.

12. A shingle as claimed in claim 10 wherein the film has an image applied thereto that contributes to the appearance of a predetermined surface.

13. A shingle as claimed in claim 12 wherein the film is embossed with a pattern that contributes to the appearance of a predetermined surface.

14. A shingle as claimed in claim 13 wherein the pattern embossed in the film is aligned with the image applied to the film.

* * * * *